United States Patent [19]

Glowacki

[11] 3,975,864

[45] Aug. 24, 1976

[54] GRINDING SYSTEM

[75] Inventor: John J. Glowacki, Orange, Conn.

[73] Assignee: J. J. Glowacki Associates, North Branford, Conn.

[22] Filed: Aug. 8, 1973

[21] Appl. No.: 386,835

[52] U.S. Cl. ..... 51/165.87; 51/227 H
[51] Int. Cl.[2] ..... B24B 19/18
[58] Field of Search ..... 51/165 R, 165.87, 227 H

[56] References Cited

UNITED STATES PATENTS

| | | | |
|---|---|---|---|
| 494,058 | 3/1893 | Church | 51/165.87 |
| 2,525,264 | 10/1950 | Milner | 51/227 H |
| 2,802,310 | 8/1957 | Chaplik | 51/227 H |
| 3,157,969 | 11/1964 | Fant | 51/165.87 |
| 3,641,714 | 2/1972 | Asano | 51/165.87 |

*Primary Examiner*—Harold D. Whitehead
*Attorney, Agent, or Firm*—Delio and Montgomery

[57] ABSTRACT

A method and apparatus for grinding work which dresses a grinding wheel which comprises sensing the surface of the grinding wheel at the finish dimension after the grinding wheel has been advanced in predetermined increments, then retracting the wheel a predetermined distance so that the surface of the grinding wheel is always in the same position prior to initiation of a grinding cycle.

6 Claims, 14 Drawing Figures

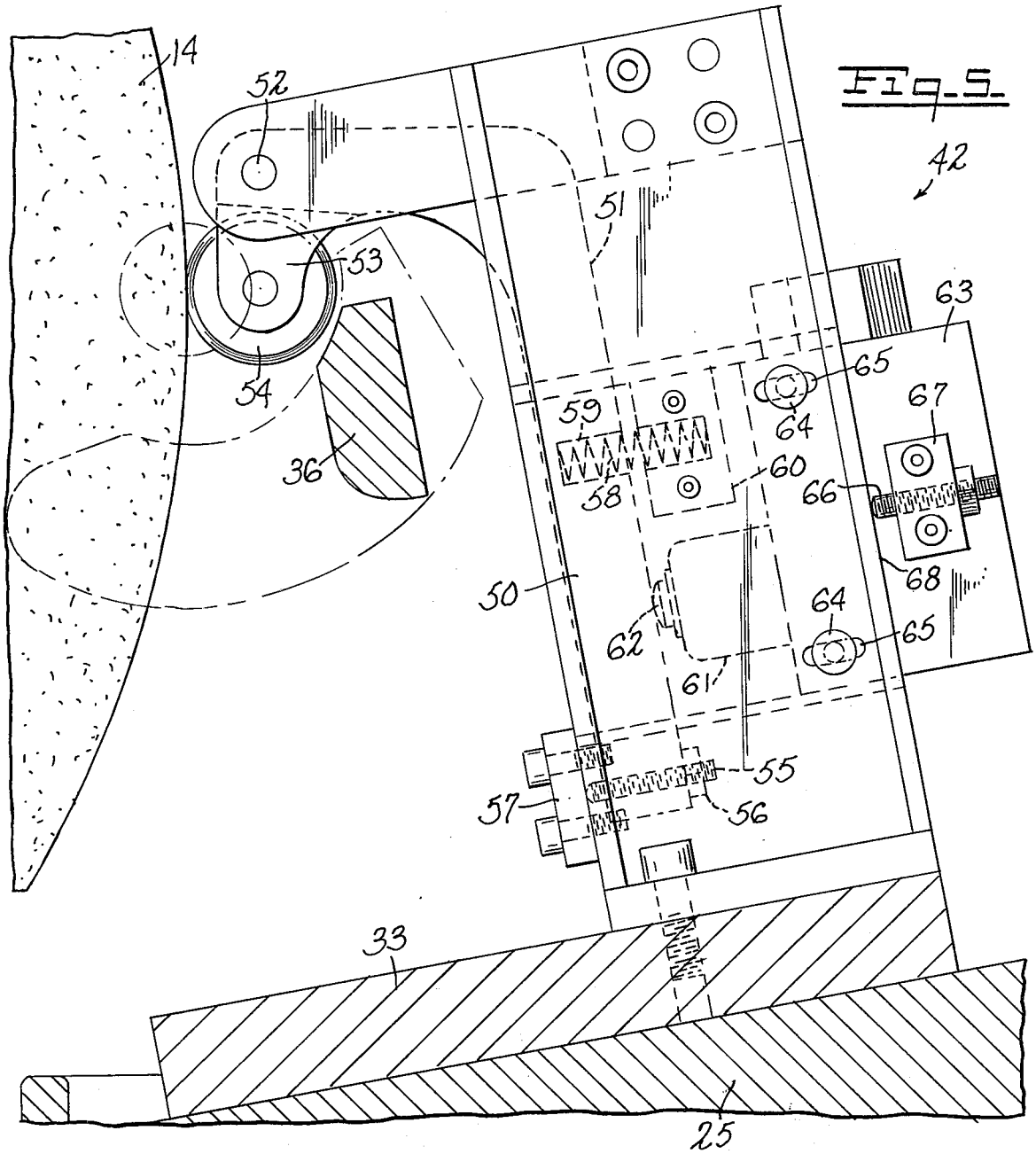
Fig. 5.
Fig. 6.
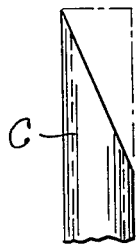
Fig. 7.
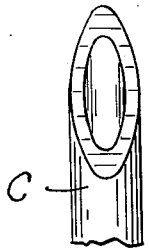
Fig. 8.
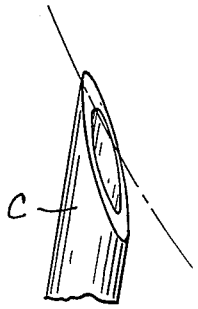
Fig. 9.
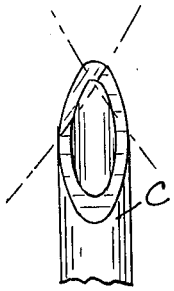
Fig. 10.
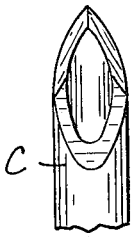

PB1
TS1
T1S1
TM1
T2S1
M2
120
T2S11
PB2
CR1
T2S3
SL2
126
CR1
T1S3
SL3
T1S2
46
T2S7
SL4
T2S8
SL5
122
124
T2S9
SL6
T2S10
123
T2S6
T2S5
T2S1
T2S4
SL1
125
TS2
61
CR2
T1S5
27
28
D
E
CR2
F
CONTROL UNIT
A
B
H
MOTOR
21
G
121

GRINDING SYSTEM

This invention relates to the grinding of workpieces.

In the use of grinding wheels to cut or finish workpieces with a grinding wheel, the workpieces carried on a table are moved relative to the cutting surface of the grinding wheel and at the end of such passes the wheel is infed a given increment for the next cut.

In programmed grinding systems, the grinding wheel is periodically dressed or trued. This is done to sharpen or clean the cutting surface, and also to predetermine a new diameter of the wheel. The new diameter is then algebraically added to the previously known position (as stored in a memory or position counter) to determine the new position of the cutting surface with respect to a reference plane, usually the surface of the work table. Such systems are generally under numerical control and operate to infeed the grinding wheel to a measured distance from a reference plane. These systems are generally highly accurate, quite sophisticated, and accordingly rather expensive.

The present invention provides a grinding system which does not require highly sophisticated controls, but which permits the rapid grinding of workpieces to a given dimension under automatic control. The invention is particularly adapted for use in applications where the control is not related to the finish dimension of the work, and where the work exhibits a definite dressing operation on the grinding wheel.

In the grinding of points on cannulas for hypodermic needles, a grinding wheel of very large relative diameter (say 18 inches) is utilized to grind tube stock (example 0.032 inch) which is positioned at a small acute angle to the vertical. A plurality of passes are made at small infeed increments (usually all uniform) until the machine operator manually determines that the final cut has been made. Then the ground ends are deburred and the tubes rotated for the lancet cuts.

The present invention provides a new and improved grinding technique for this type of work where all cuts are made automatically in a fewer number of infeed increments and the dressing of the wheel by the work is automatically compensated.

Briefly stated, the invention in one form thereof comprises the provision of a means for sensing the position of the surface of wheel on the final pass in a cutting cycle and then retracting the wheel a predetermined distance to a known position. On the next cutting cycle, the wheel is infed in predetermined increments on each pass, until the sensing means detects the surface of the wheel and the wheel is again retracted the predetermined distance. With this arrangement, the dressing of the wheel is inherently compensated and the cutting surface of the wheel always commences a cycle of operation from the same position.

An object of this invention is to provide a new and improved system for grinding workpieces which act to dress a grinding wheel.

The features of the invention which are believed to be novel are particularly pointed out and distinctly claimed in the concluding portion of this specification. The invention, however, both as to its organization and operation, together with further objects and advantages thereof may best be appreciated by reference to the following detailed description taken in conjunction with the drawings, wherein:

FIG. 5 is a view seen in the plane of lines 5—5 of FIG. 3.

FIGS. 6 – 10 are viewed of the ground end of a cannula as it appears during successive steps of grinding;

Figure 1:
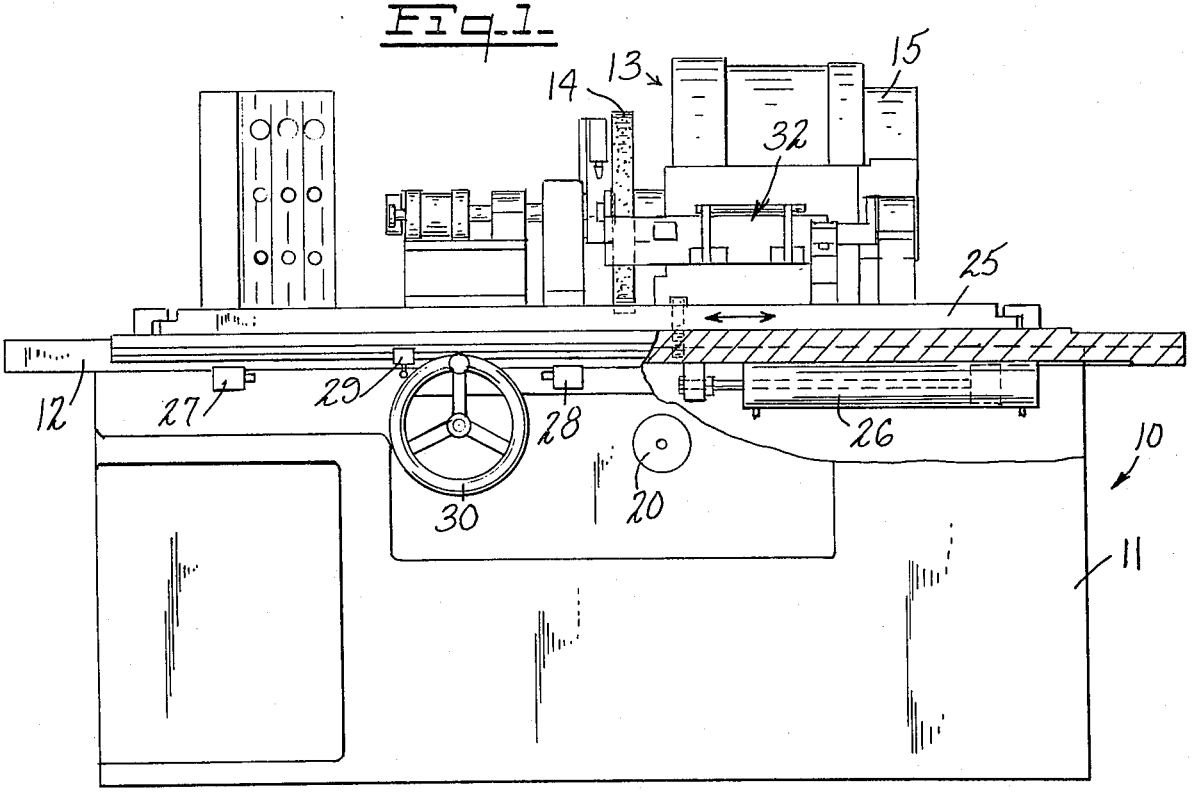
FIG. 1 is a front elevation of a grinding machine on which the invention may be embodied.
Figure 2:
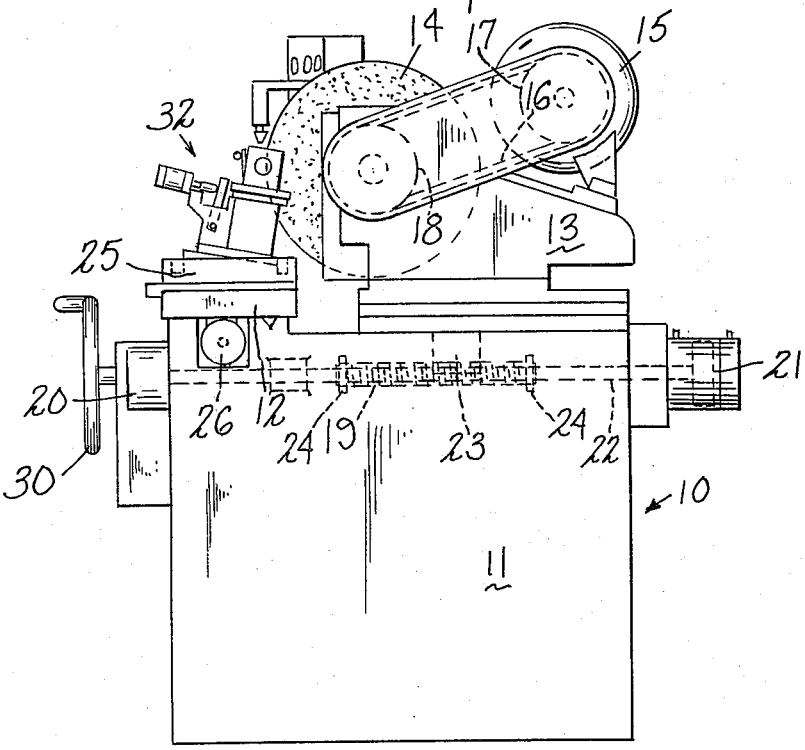
FIG. 2 is a side elevation of the machine of FIG. 1.

The invention may be utilized in a grinding machine 10 as shown in FIGS. 1 and 2 which generally comprise a support member 11 having a table or bed 12 adapted to move longitudinally thereon. Member 11 supports thereon a wheelhead 13 which comprises a grinding wheel 14 driven by a motor 15 through a belt 16 and pulleys 17 and 18. The wheelhead 13 is adapted to be advanced and retracted by means of a lead screw 19 which may be driven either by a stepping motor 20 or moved longitudinally by a fast traverse cylinder 21 which may be hydraulically operated. Lead screw 19 is carried on the piston rod 22 of cylinder 21. Rod 22 is supported at spaced points on frame 11. The lead screw may receive thereon one or more traveling nuts 23 depending from the wheelhead. Lead screw 19 is geared to motor 20 by a gear train (not shown). Collars 24 may be provided to position lead screw 19 on rod 22. A fixture 25 is securely mounted on table 12. Table 12 is adapted to be reciprocated back and forth as by means of a hydraulically operated piston cylinder assembly 26 between limits of travel as may be determined by positionable limits (not shown in FIG. 2) which will reverse the operation of cylinder 26. A pair of dogs 27 and 28 are also positionable on table 12 to actuate a switch 29 to signify an infeed increment at the desired limits of travel of the table. The grinding machine will conventionally also include a manual table positioning device which may be in the form of a hand wheel 30. A further hand wheel (not shown) is included on the grinding machine and coupled through suitable gearing to lead screw 19 to permit manual advance and retract of the wheel head.

The invention will be described as embodied in a device for grinding a point on hypodermic needles.

To this end a fixture 32 is provided which includes a base member 33 which is bolted to fixture 25. Fixture 32, as more clearly seen in FIGS. 3 and 4, includes a cannula holding fixture 34. Fixture 34 is carried on supports 35 and 36 which have journals 37 and 38 extending therefrom. Journals 37 and 38 are rotatably carried in supports 39 and 40, respectively, A wheel surface sensing device 42 is positioned on fixture 32.

A fixture positioning device in the form of a hydraulic or pneumatic motor 43 is arranged to rotate journal 38 through a coupling 44. A position indicating cam 45 is on an extension of the shaft of motor 43 and is adapted to coact with a switch 46 for purposes hereinafter described.

The sensing device 42, FIG. 5, includes an upright frame member 50 having spaced apart walls, with an arm 51 of generally L-shape pivotally mounted between the walls about a pin 52. Arm 51 carries on an end 53 thereof a roller member 54 of very hard material, such as tungsten carbide, which may be contacted by the surface of wheel 14. Roller 54 is disposed below the pivotal axis of pin 52.

A predetermined position of arm 51 may be set as by means of an adjusting bolt or screw 55 threadably received through the lower portion of arm 51 and carrying a locking nut 56 thereon. The end of adjustment 55 contacts a plate 57 mounted to housing 50.

Arm 51 is normally biased into the position determined by adjustment 55 as by means of a spring 58 extending between a pocket 59 in arm 51 and a pocket-defining member 60 carried on one of the side frames.

As shown, when roller 54 is contacted by the cutting surface or the edge of grinding wheel 14, arm 51 will pivot in a counterclockwise direction, in the view shown, and will actuate a switch 61 having an operating contact 62. The surface of roller 54 is defined on a radius and only slight contact with the wheel 14 will pivot lever 51. As roller 54 is contacted, it will move away from wheel 14. The periphery of wheel 54 coincides with the center line of journals 37 and 38, and also the desired finish cut line on the work. Switch 61 is carried on a member 63 which, in turn, is slidably mounted to housing 50 as by means of bolts 64 in slots 65 defined in the side wall of housing 50. A positioning device in the form of a screw 66 received through a threaded member 67 is adapted to bear on a surface 68 of housing 50 so that the position of switch 61 may be adjustably predetermined.

The device 42 is so positioned to detect the surface of the wheel when the final cut is made on the cannulas. The axis of roller 54 is in the same horizontal plane as the axis of wheel 14.

Figure 11:
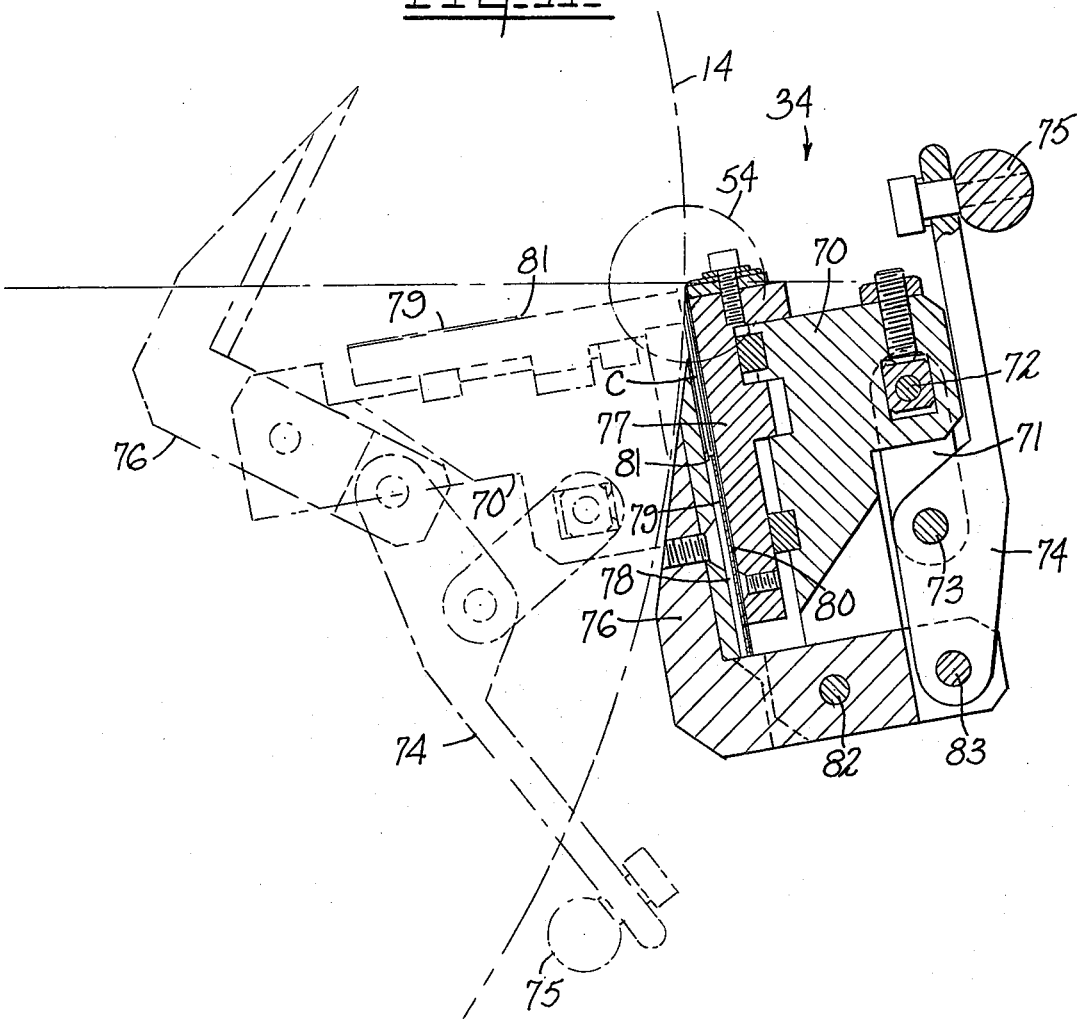
FIG. 11 is a view seen in the plane of lines 11—11 of FIG. 2.

FIG. 11 discloses a device for holding tubing which is to be ground to cannulas for use in hypodermic needles. Holder 34 comprises a body member 70 which pivotally carries a pair of spaced-apart links 71 that are pivoted as shown at 72. Links 71 are further pivotally mounted about pins 73 to a pair of links 74 which have an operating handle 75 extending therebetween.

The purpose of this lever arrangement is to open the jaw 76 of cannula holder 34 to the position shown in broken line. A member 77 adjustably positioned on body member 70 defines with jaw 76 a holder for cannulas C in the form of an elongated slot or passage 78. A removable member 79 may be inserted against surface 80 to provide a stop 81 for cannulas of varying lengths.

Jaw member 76 is pivoted to body member 70 at 82, and to links 74 by pins 83. Thus when handle member 75 is moved to the position shown in broken line, the jaw will be opened and the overall mechanism will be swung to the position in broken line. Then the tubes to be ground to cannulas may be inserted in the fixture, the jaw closed with a row of tubes C positioned therein for grinding.

In the grinding of hypodermic needles, it is conventional practice that after making a main cut to give the lance point or primary bevel, the cannulas are slightly rotated and further grinding or lancet cuts are made. This is illustrated in FIGS. 6 – 10. FIG. 6 is a side view of the primary cuts made on the cannulas by the grinding wheel and FIG. 7 is a front view thereof. FIG. 8 shows how the previously ground end of the cannulas may be rotated slightly for one lancet cut and FIG. 9 is a full front view of the cannula of FIG. 8. The cannula is then rotated in the opposite direction and another lancet cut made to provide the final configuration shown in FIG. 10.

To provide the necessary rotational movement of the cannulas in the holder 34, member 77 is adapted to be moved with respect to jaw 76 to rotate the cannulas C for the lancet cuts.

Figure 4:
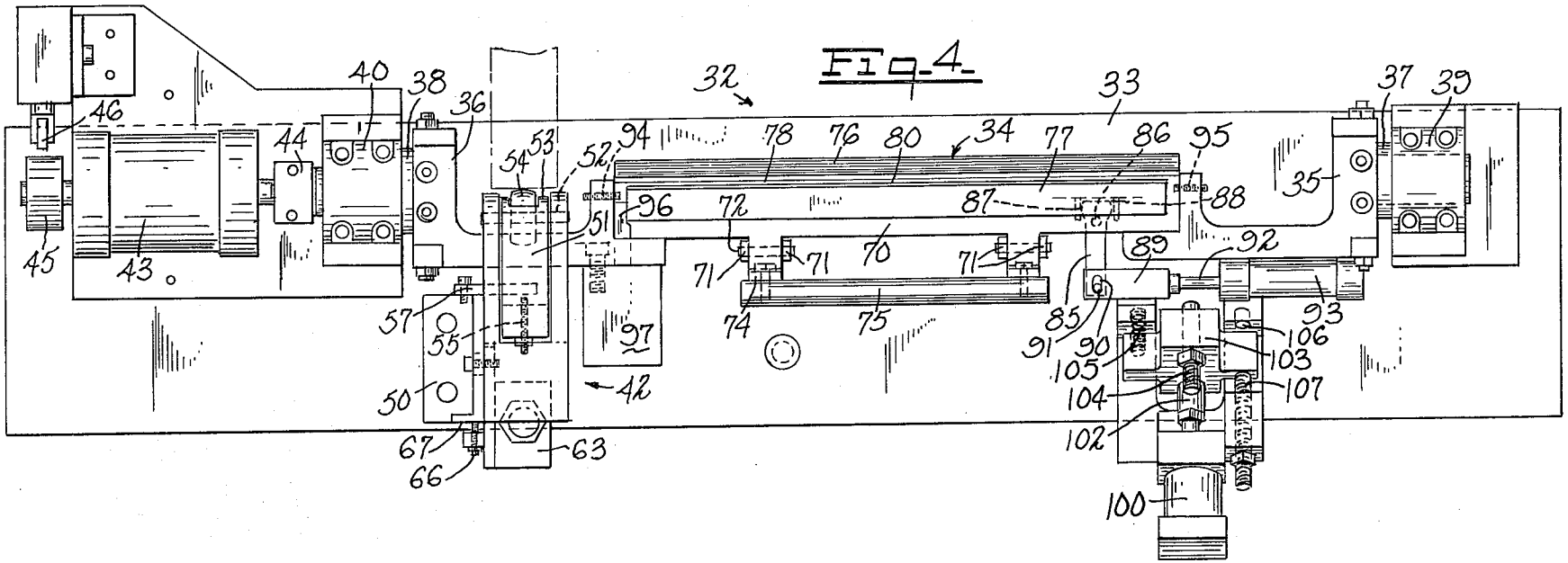
FIG. 4 is a top view of the device of FIG. 3.
Figure 12:
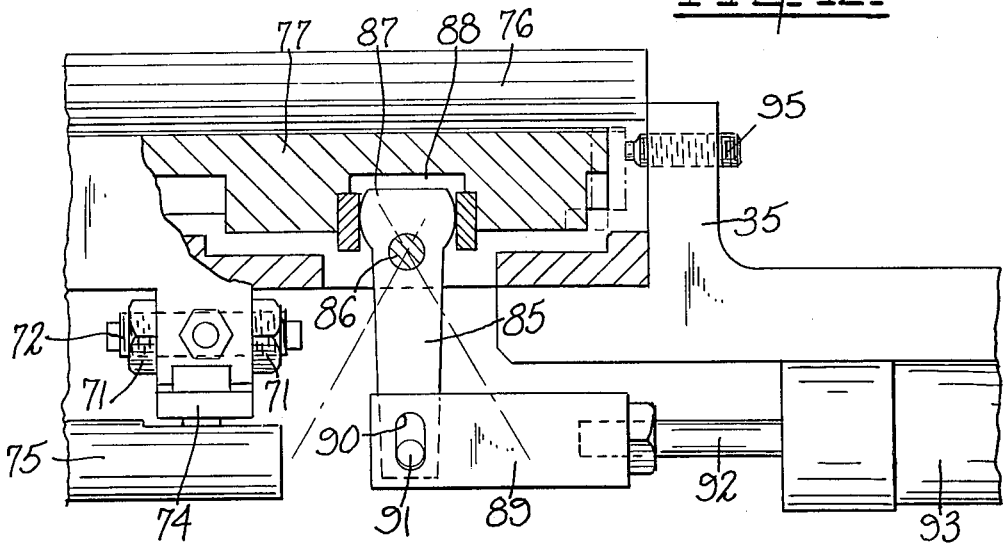
FIG. 12 is an enlarged view, partially cut-away, of the workholding fixture of FIG. 4.

A lever 85 is pivotally mounted to body member 70 as shown at 86 (FIG. 4) and includes a head 87 adapted to act against the sides of a cutout or recess 88 in member 77. The other end of lever 85 is engaged by a member 89 having a slot 90 to receive a pin 91 on lever 85 therein. Member 89 is linearly movable in two directions by the piston 92 of a cylinder 93. Member 77 is movable between two extreme positions determined by a first adjustable stopping member 94 carried in support 36 and a second stopping member 95 carried in support 35 as shown in FIG. 4. A retractable centering pin or wedge 96 actuated by a cylinder 97 will permit movement of member 77 to the left as shown in FIG. 4. Thereafter, when pressure to the double-acting cylinder 93 is reversed member 77 is moved to the right until it strikes stop 95. Thereafter, wedge 96 is reinserted into the space as shown in FIG. 4 and the cylinder 93 returns member 77 to the center position shown.

Prior to rotating the cannulas C for the lancet cuts, the angles of cannulas are slightly changed as hereinafter described.

During a grinding cycle, motor 43 maintains the cannulas at a first angle to the vertical. The holder 34 is rotated slightly so as to present the cannulas at a slightly greater angle to the vertical for the lancet cuts.

Figure 3:
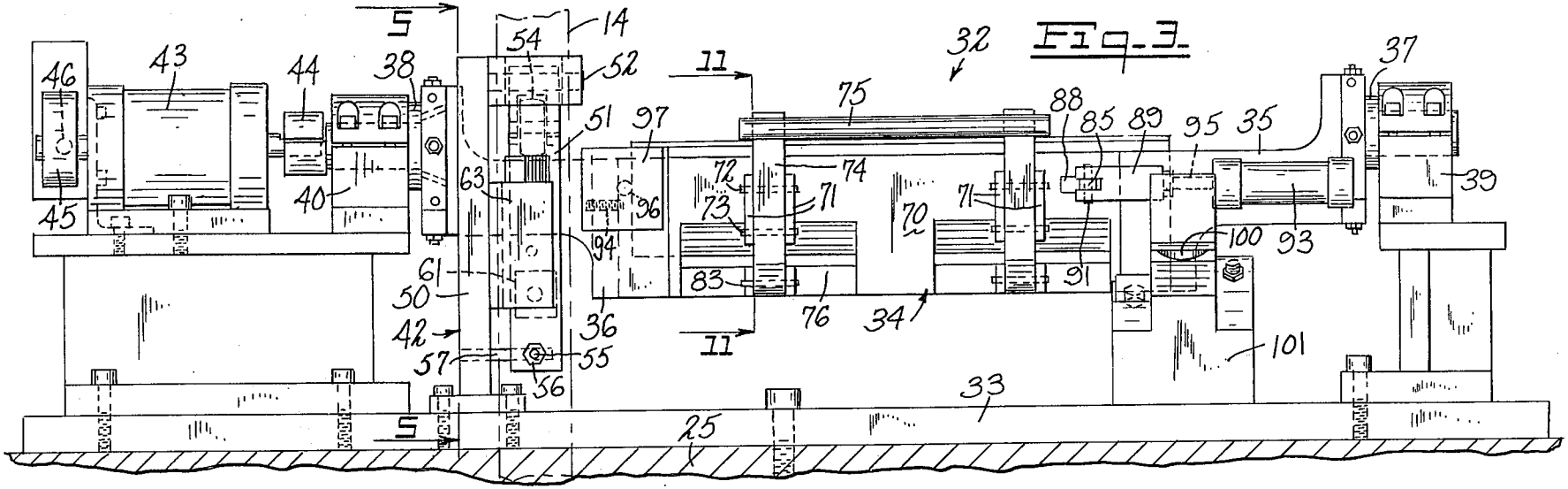
FIG. 3 is a front elevation of a fixture disposed on the bed of the grinding machine.

This is accomplished by adjusting the position of a stop member against support 35 during the primary grinding cycle, and then during the lancet grinding cycle to move said stop and permit a small degree of rotational movement of the cannula holder about the center of journals 37 and 38. As shown in FIGS. 3 and 4 a cylinder 100 mounted to a sub-fixture 101 on fixture 32 has its piston 102 engage a lever 103. Lever 103 is pivoted to fixture 101 adjacent its lower end (not shown). Lever 103 also carries an adjustable stopping member 104 in the form of a bolt threaded therethrough with a lock nut thereon. The end of stop 104 engages support 35. When the piston 102 is retracted, motor 43 may rotate carrier 70 a few degrees until member 35 engages adjustable stop 103 which is repositioned by retraction of piston 102. At this time the cannulas with the primary ground points thereon are pivoted about a point which coincides with the center of journals 37 and 38. A spring 105 urges lever 103 toward piston 102. Stops 106 and 107 on sub-fixture 101 determine the limits of movement of lever 103.

A cycle of operation of the system may be briefly summarized as follows:

When a plurality of tubes have been placed in fixture 34 a cycle start switch is closed. This will cause motor 43 to rotate fixture 34 to a position determined by cam 45 and switch 46 and place the tubes at an angle substantially as shown in FIG. 11. Thereafter the grinding wheel is rapidly advanced by cylinder 21 to a given position ready for the first cut and the table is caused to traverse. The table traverse control is an inherent part of the grinder and operates in response to connecting the hydraulic system of the grinder to a source of hydraulic fluid pressure as hereinafter described. Cylinder 26 traverses the table between limits set by a positioning valve on the frame and dogs 113 and 114 (FIG. 13) positionable on table 12.

Thereafter, on each traverse of the table past the grinding wheel, the wheel is advanced in predetermined increments until such time as the surface of the wheel is sensed by sensor 42.

At this time, the table traverse is disabled for a predetermined time. The tubes will have been ground to have the primary bevel as shown in FIGS. 6 and 7. Then, cylinder 100 is operated to reposition fixture 34 by moving the limiting member 104 and permit motor 43 to rotate fixture 34 to the new position. Then cylinder 93 is operated to permit removal of centering pin 96 and initially free the cannulas for rotation. Cylinder 97 is operated to withdraw centering pin 96 and cylinder 93 is operated to move member 77 to the left as viewed in FIG. 4 which will give a predetermined degree of rotation to the cannulas as shown in FIG. 8. A table index solenoid is then energized for a traverse to make a first lancet cut. Thereafter, cylinder 93 is operated in the reverse direction for the second lancet cut. Following this, the centering pin or wedge 96 is reinserted by cylinder 97 and cylinder 93 returns member 77 to the position shown in FIG. 4. The table stops at the end of the second lancet cut. Then the grinding wheel will effect a reverse movement to a known position and the fixture is returned to its loading position. The return is accomplished in two steps. There is a rapid retract by cylinder 21 a first predetermined distance, and a retract by stepping motor 20, a second predetermined distance. The retract steps are interchangeable.

Figure 13:
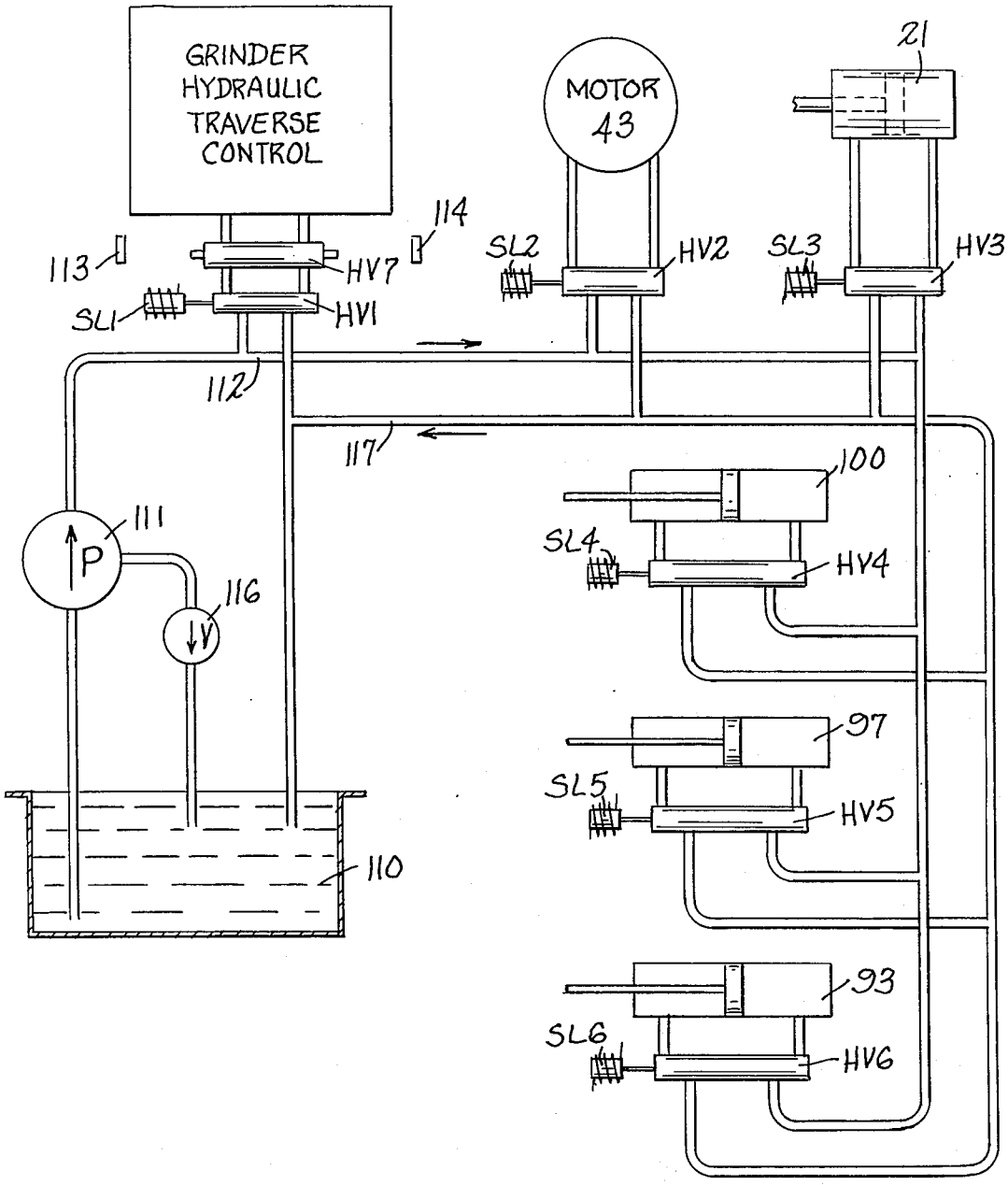
FIG. 13 is a schematic diagram of a hydraulic system for a grinding system embodying the invention.

Reference is now made to FIG. 13 which exemplifies a hydraulic control circuit which may be utilized in conjunction with the invention. Hydraulic fluid is drawn from a reservoir 110 by a pump 111 and applied to a pressure line 112. Pressure line 112 connects to a traverse control valve HV1 and two-way hydraulic valves HV2 – HV6. The position of the valves HV1 – HV6 are controlled by corresponding solenoids SL1 – SL6. A valve HV7 is actuated by positionable stops 113 and 114 on table 12. Valve HV1 may be mounted on housing 11. As valve HV1 is actuated the piston of cylinder 26 initiates traverse of the table. Valve HV2 and solenoid SL2 operate to control the direction of rotation of motor 43. Valve HV3 and solenoid SL3 operate to control rapid approach cylinder 20. Valve HV4 and solenoid SL4 operate to control cylinder 100 for positioning and repositioning of fixture 34. Valve HV5 and solenoid SL5 control the operation of cylinder 97 which operates the wedge or centering pin 96. Valve HV6 and solenoid SL6 control the operation of cylinder 93 which moves the member 77 to rotate the cannulas for the lancet cut. The valves HV1 – HV6 are also connected to a fluid return line 117. The valves operate to selectively direct hydraulic fluid to the various actuating devices. A pressure regulating or relief valve 116 is also provided about pump 111.

When solenoid SL5 is in a de-energized condition valve HV5 will be so positioned that the piston of cylinder 97 extends centering pin 96. When solenoid SL6 is de-energized valve HV6 will be in a position such that the piston 92 of cylinder 93 urges member 77 to the left as viewed in FIG. 4.

When solenoid SL4 is de-energized the piston of cylinder 93 will be positioned such that stop member 104 will hold support 35 so that the fixture 34 is in position for the primary bevel cut.

While the various actuating devices are illustrated as hydraulically operated, it is to be understood that some or all may be pneumatic devices, particularly the motor 43 and cylinder 21 which operate between fixed limits.

The system operates in a preferred manner on a timing system which includes two timing devices in the form of small geared down synchronous motors each driving a shaft having a plurality of cams thereon which operate switches in predetermined sequences.

Figure 14:
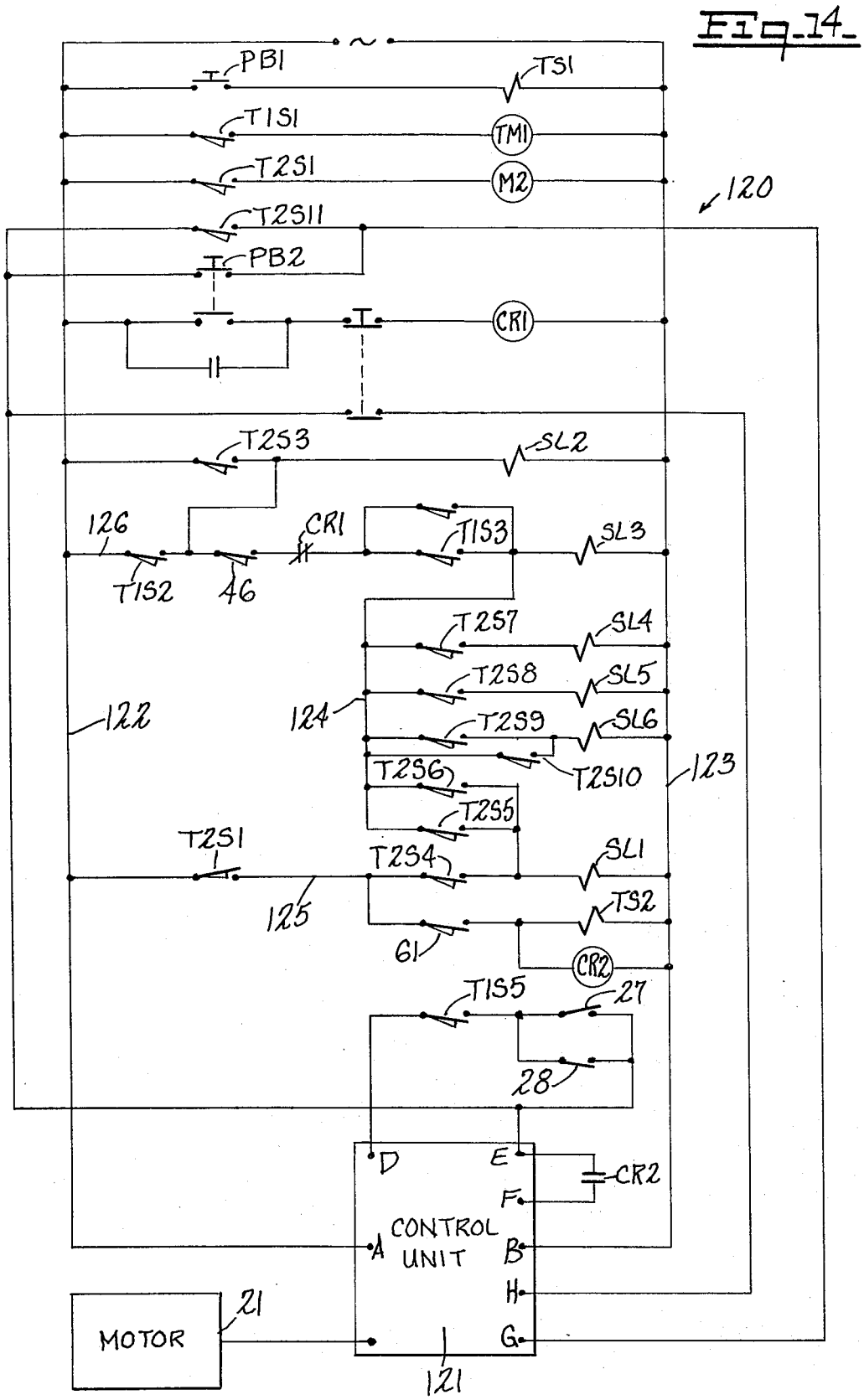
FIG. 14 is a schematic diagram of the electrical control system for a grinding system embodying the invention.

These timing devices including the motor, a solenoid for connecting the motor to the cam shaft by a latch or clutch and the included cams and switches are well known in the art, and therefore only the functional portions thereof are illustrated in conjunction with the electrical schematic diagram of FIG. 14. A more detailed cycle of operation will now be described in conjunction with FIGS. 13 and 14.

A very important portion of the network 120 of FIG. 14 is a control unit 121 which provides a number of signals in the form of pulse trains to a stepping motor, and which includes controls for predetermining the number of pulses applied to the stepping motor in increments upon a command. The incremental motion of the grinding wheel is thus predetermined by setting each increment into the control by dials provided therefor. Then the unit 121 will supply a pulse train having a predetermined number of pulses to stepping motor 21 as will hereinafter be described. The programming of unit 121 operates to infeed grinding wheel 14 after each table index until the cutting surface of wheel 14 is sensed by sensor 42 and a signal indicative thereof is applied to unit 121.

The control unit is a commercially available item which may be programmed to produce infeed movement of a motor driven object in predetermined increments and to retract the object a fixed distance at the end of a cycle of such infeed increments.

One suitable control 121 is a SMD-32 programmer available from Icon Corporation of Cambridge, Mass., a subsidiary of USM Corporation.

The controller is programmed to operate as follows:

1. From a known position of the surface of the grinding wheel, it will incrementally infeed the wheel on each pass of the work in predetermined increments.
2. When the surface of the grinding wheel reaches a predetermined infeed position, further infeed is halted even if the last increment is not complete.
3. Then the wheel is retracted a fixed distance such that the cutting surface is in essentially the same position as it was for the first cut before the first infeed increment.

By way of example, the wheel may have a programmed infeed in decreasing increments with final increments on the order of 0.001 inch until the cutting surface of the wheel is sensed.

The network 120 includes a plurality of switches and control elements connected between control power lines 122 and 123. The control unit 121 receives power over lines 122 and 123 to inputs A and B thereof. Closing of the circuit between inputs D and E thereof will cause the unit 121 to provide an incremental advance signal to infeed motor 21. The unit 121 is rendered inoperative when the circuit between terminals E and F is complete. A fixed distance retract signal is given when the circuit between terminals E and G is closed. A signal applied by closing a circuit between terminals H and E acts to enable the unit after it has been inhibited as hereinafter described.

A cycle of operation is commenced when start switch PB1 is closed. This energizes the solenoid TS1 of a first timer and operates the motor TM1 thereof. As motor TM1 operates it will operate a plurality of switches T1S5. Switch T1S1 is closed to latch in the motor TM1 of the first timer. Switch T1S2 will then close to operate solenoid valve SL2. Solenoid S12 operates valve HV2 and motor 43 rotates fixture 34 until cam 45 closes switch 46. Then switch T1S3 closes, a circuit to other timer operated switches connected between lines 124 and 123 is made, and rapid approach solenoid SL3 is energized and cylinder 20 approaches wheel 14 toward fixture 34 to a fixed distance from a known retract position. The wheel is now positioned for a first cut which may be half of the total grinding dimension.

At this time switch T1S4 closes and table index solenoid SL1 is energized. This positions valve HV1 to activate the grinder traverse control and reciprocate table 12 between the limits set by dogs 113 and 114.

Switch T1S5 then closes. Table 12 will traverse between switches 27 and 28 and infeed a predetermined increment each traversal. When the wheel is detected by sensor 42, switch 61 is closed and solenoid TS2 for the second timer motor is energized. A double switch T2S1 is operated to latch in motor TM2, and to open line 125 from line 122.

Traverse of table 12 temporarily ceases when line 125 is opened, inasmuch as solenoid SL1 is de-energized. Then the table is reciprocated to pass the ground cannulas beneath a nozzle (not shown) which emits deburring powder under the control of timer switches T2S5 and T2S4. At this time, switch T1S5 has opened and no infeed signal is applied to control unit 121.

Switch T2S7 is closed to energize solenoid S14. This positions valve HV4 such that stop 104 is repositioned as motor 43 slightly rotates fixture 34 to change the angle of fixture 34 and hence the angle of the cannulas. Switch T2S8 then operates solenoid SL6 to cause cylinder 93 to move member 77 to the right as viewed in FIG. 4. Then switch T2S9 closes to energize solenoid SL5, and cylinder 97 withdraws centering pin 96. Switch T2S8 then opens and cylinder 93 moves member 77 to rotate the cannulas for the first lancet cut. When this occurs, cylinder 93 moves member 77 to the left, as viewed in FIG. 4, and rotates the cannulas, as exemplified in FIG. 8.

Switch T2S5 again closes to energize solenoid S11 to cause table 12 to traverse the wheel twice for the lancet cuts. After the first index switch T2S10 closes to again energize solenoid SL6. This positions valve HV6 to cause cylinder 93 to rotate the cannulas in the opposite direction for the second lancet cut on the return pass. Then switch T2S6 will open to de-energize solenoid SL1 and table traverse will stop. Switch T2S7 will open, de-energizing solenoid SL4 and cylinder 97 will reinsert pin 96 to center fixture 34. Switch T2S10 will open and de-energize solenoid SL6, and cylinder 93 will reposition member 77 against centering pin 96. Switch T2S7 opens, de-energizing solenoid SL4.

Switch T2S3 opens, de-energizing solenoid SL2 and motor 43 rotates fixture 34 to an unloading position.

Then switch 46 opens and solenoid SL3 is de-energized, valve HV3 is repositioned, and cylinder 21 rapidly retracts wheel 14 a fixed distance. Then switch T2S11 closes and applies a cycle complete signal to terminals E and G of the control unit 121 to retract the grinding wheel. The stepping motor is then operated to retract the wheel a fixed distance to a known position of the wheel cutting surface for another cycle of operation.

The fixture is then unloaded, and reloaded. The wheel is now positioned a known distance from the next finish point to make a cut on the newly loaded tubes on the first traverse. A new cycle is commenced by again closing switch PB1.

The relay CR1, when energized by closing switch PB2, will drop out its contact in line 126 and disable all hydraulics, and also act in the same manner as switch T2S11 to produce a fixed distance retract of the wheel. To reset the control, switch PB2 is opened to de-energize relay CR1, and apply a reset signal to terminals E and H of unit 121. The relay CR2 when energized at the end of an infeeding cycle by switch 61 opens its contact between terminals E and F of unit 121, to halt any further infeed.

Figure 15:
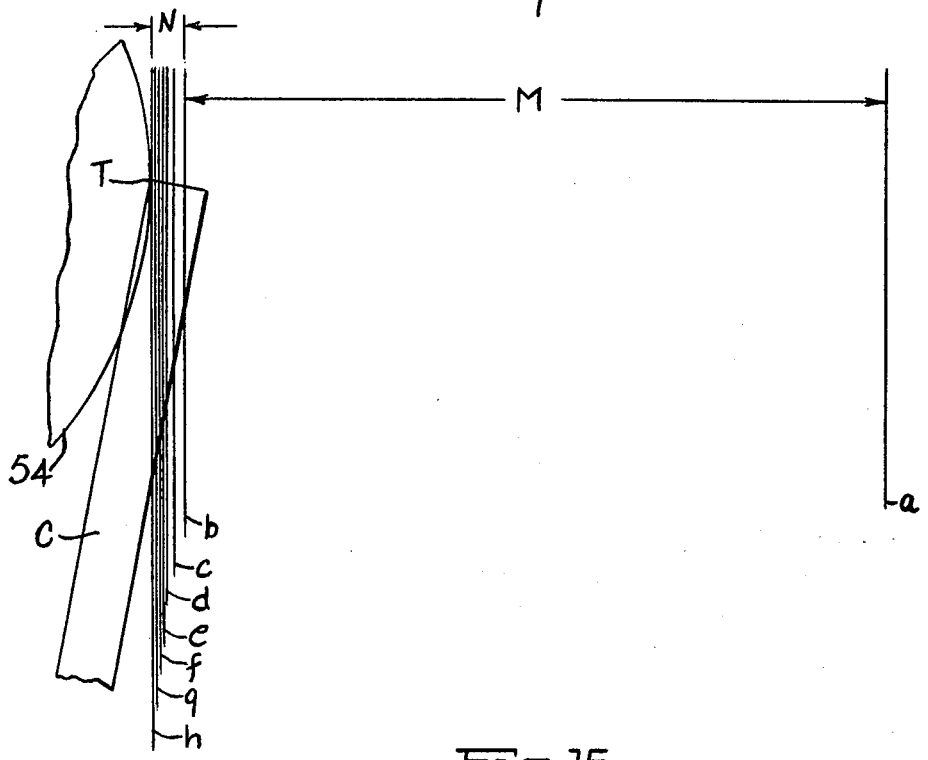
FIG. 15 is a schematic view of a grinding wheel and representing a workpiece cycle of operation.

FIG. 15 is diagrammatically illustrative of the infeed operation of the machine. The various positions of the grinding wheel are denoted by the reference letters *a* – N.

Position *a* represents the full retract position. The wheel is moved from position *a* to position *b*, a distance M by rapid approach cylinder 21. This places the wheel at position *b* to take a large cut on the first traverse. Thereafter the infeed increments may be progressively smaller as follows:

| | | |
|---|---|---|
| Position | b – e | .0075″ |
| | c – d | .0050″ |
| | d – e | .0025″ |
| | e – f | .0025″ |
| | g – h | .0025″ |
| Retract | h – b (N) | .0175″ |

The dimensions given above are selected for a 0.032 inch diameter tube. After the lancet cuts are made, the wheel is retracted the predetermined distance programmed in control unit 121 to position *b*, and then rapidly retracted distance M by cylinder 21 to position *a*. The two retract steps are interchangeable.

During the infeed the radius of the grinding wheel may be reduced approximately 0.005 inch. Therefore the surface will be sensed during the last traverse after infeed to position *h*. Upon retract by control unit 121 the distance N, the wheel surface is in the position in which it will take its first cut on the next cycle.

The retract of the wheel surface is a fixed distance and always places the cutting surface of the wheel in a known position with respect to the sensor, regardless of the radius loss of the wheel. In the example given, the wheel will never overcut the tip T of the cannula by as much as 0.001 inch.

Figure 16:
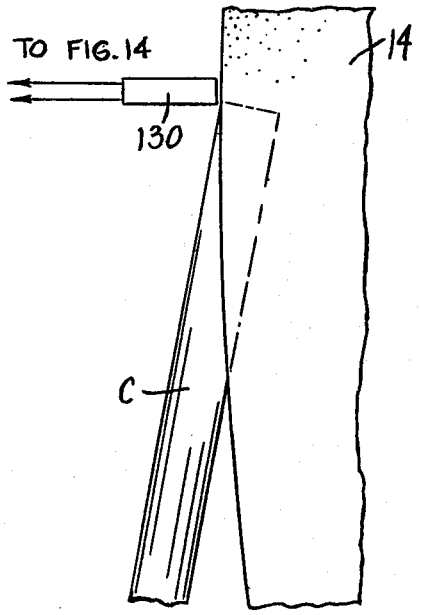
FIG. 16 is a simplified diagram showing the use of a fluidic proximity detector to sense a predetermined position of a grinding wheel.

The device used to sense the cutting surface of the grinding wheel on the final pass of the primary bevel cut may take various forms. While a mechanical contact has been exemplified, non-contacting proximity detectors such as a pneumatic proximity detector may be utilized. FIG. 16 exemplifies such a detector 130, which operates on the principle of detecting a predetermined pneumatic back pressure when the surface of the wheel 14 approaches within a predetermined distance. The detector then operates a switch equivalent to switch 61. Many detectors of this type are commercially available. A suitable detector of this type is a Model 6090-187 Back Pressure Sensor and a Model 6080-158 Fluidic Electric Switch manufactured by Automatic Switch Company of Florham Park, New Jersey.

It may thus be seen that the objects set forth above as well as those made apparent from the preceding description are efficiently attained. While a preferred embodiment of the invention has been set forth for purposes of disclosure, it is to be understood that other embodiments to the invention as well as modifications to the disclosed embodiment which do not depart from the spirit and scope of the invention may become apparent to those skilled in the art. Accordingly, the appended claims are intended to cover all embodiments and modifications of the invention which do not depart from the spirit and scope of the invention.

What is claimed is:

1. Apparatus for grinding points on the ends of tubes to produce cannulas including a grinding machine having a grinding wheel thereon, a table, means for moving said grinding wheel toward and away from said table, said tubes acting to dress the wheel and reduce the diameter thereof, means for relatively moving the table past the cutting surface of the wheel; a fixture on said table adapted to hold a plurality of aligned tubes positioned at a small angle to the vertical and present the ends thereof to the cutting surface of the wheel, control means for causing said means for moving to advance said wheel a predetermined increment toward the tubes upon each relative movement of the table past the wheel, wheel surface sensing means positioned on said table and adapted to sense a predetermined position of the wheel surface, means responsive to said sensing means for halting further advance of the grinding wheel, said control means being arranged thereafter to retract said grinding wheel so that the cutting surface of the wheel upon retract is a fixed distance from said wheel surface sensing means.

2. The apparatus of claim 1, wherein said means for moving said grinding wheel toward and away from said table includes first and second means, said first means moving said grinding wheel at a rapid rate a first fixed distance, said second means moving said wheel in said predetermined increments, means responsive to initiation of a cycle of operation for causing said first means to advance said wheel from a retract position to a position where it is positioned to make a cut on the tubes on the first traverse, said second drive means advancing said table in said increments, means responsive to completion of a cycle of operation, for causing said second drive means to retract said wheel a second fixed distance where the wheel is positioned for a cut upon traverse, and causing said first drive means to retract said wheel said first fixed distance.

3. The apparatus of claim 1 wherein said wheel surface sensing means includes a roller having a center in a horizontal plane which includes the axis of said grinding wheel, the periphery of said roller defining the point of last cut of said grinding wheel on said tubes.

4. The apparatus of claim 3 wherein said wheel surface sensing means is a non-contacting fluid proximity detector which senses advance of the surface of said grinding wheel to a predetermined position.

5. The apparatus of claim 1 wherein said fixture is rotatable about an axis, and the finished end of the tubes essentially coincides with said axis, means responsive to said sensing means for sensing said predetermined position of said wheel for rotating said fixture to a slightly greater angle to the vertical, rotating said tubes in said fixture to first and second positions and causing said means for relatively moving to cause said table to traverse said wheel in said predetermined position while said tubes are in said first and second positions.

6. For use in combination with a grinding machine having a grinding wheel thereon movable toward and from work on the machine where the workpiece acts to dress the wheel and reduce the diameter thereof, means for relatively moving the workpiece past the cutting surface of the wheel and means for moving said wheelhead toward and away from the workpiece; the improvement comprising control means for causing said means for moving to incrementally advance said wheel toward said work from a known retract position of the cutting surface of the wheel on each relative movement of the work past the cutting surface, wheel surface sensing means positioned on said machine to sense advance of the cutting surface of said grinding wheel to a predetermined position in relation to a workpiece, means responsive to said sensing means for halting further advance of said grinding wheel, said control means being arranged thereafter to cause said means for moving to retract said grinding wheel so that the cutting surface of the wheel upon retract is a fixed distance from said wheel surface sensing means.

* * * * *